US006127653A

United States Patent [19]

Samuels

[11] Patent Number: 6,127,653

[45] Date of Patent: Oct. 3, 2000

[54] METHOD AND APPARATUS FOR MAINTAINING DRIVEWAYS AND WALKWAYS FREE OF ICE AND SNOW

[76] Inventor: Gladestone Samuels, 10712 S. Prospect Ave., Chicago, Ill. 60643

[21] Appl. No.: 09/089,170

[22] Filed: Jun. 2, 1998

[51] Int. Cl.[7] ..... H05B 1/00; H05B 3/00; H05B 11/00

[52] U.S. Cl. ..... 219/213; 219/457

[58] Field of Search ..... 219/212, 213, 219/544, 548, 412, 348, 349, 209; 126/271.1, 569, 633; 165/46, 104; 404/71, 77, 79; 392/435, 436, 437; 244/134 R

[56] References Cited

U.S. PATENT DOCUMENTS

| | | | |
|---|---|---|---|
| D. 323,036 | 1/1992 | Liu | D26/68 |
| 3,683,154 | 8/1972 | Kipple et al. | 219/412 |
| 3,806,702 | 4/1974 | Spenser | 219/528 |
| 4,026,350 | 5/1977 | Zembrzuski | 165/46 |
| 4,564,745 | 1/1986 | Deschenes | 219/213 |
| 4,646,818 | 3/1987 | Ervin, Jr. | 165/703 |
| 4,814,580 | 3/1989 | Carageorge | 219/213 |
| 4,952,775 | 8/1990 | Yokoyama et al. | 219/213 |
| 4,967,057 | 10/1990 | Bayless et al. | 219/213 |
| 5,003,157 | 3/1991 | Hargrove | 219/213 |
| 5,058,196 | 10/1991 | Nakamura et al. | 392/435 |
| 5,059,767 | 10/1991 | Marks et al. | 219/209 |
| 5,233,971 | 8/1993 | Hanley | 126/569 |
| 5,550,350 | 8/1996 | Barnes | 219/213 |
| 5,597,140 | 1/1997 | Madsen | 244/134 R |

*Primary Examiner*—Teresa Walberg
*Assistant Examiner*—Leonid Fastovsky
*Attorney, Agent, or Firm*—Goldstein & Canino

[57] ABSTRACT

A driveway heating system for maintaining outdoor paved surfaces free of snow and ice comprising a plurality of electric heating devices placed along the outdoor paved surfaces adapted to melt snow and ice therefrom in the event of a snow storm. The heating device includes a housing defined in part by exterior panels, wherein the exterior panels facing toward the pavement structure are constructed of high thermal conducting material, and the exterior panels facing away from the pavement structure are constructed of thermal insulating material designed to maximize heat transfer to the pavement structure. The housing of the heating device serves to contain an electrically powered heat source. When the heating device is activated, the heat released from the heat source raises the temperature of the exterior panels with high thermal conductivity to transfer the heat to the surrounding pavement structures, whereupon the heat radiates outwardly to melt snow and ice from anticipated sections of the paved surfaces.

5 Claims, 3 Drawing Sheets

METHOD AND APPARATUS FOR MAINTAINING DRIVEWAYS AND WALKWAYS FREE OF ICE AND SNOW

BACKGROUND OF THE INVENTION

This invention relates to a method and an apparatus for maintaining driveways and walkways free of ice and snow.

More particularly, the invention relates to a driveway heating system which employs a plurality of heating devices placed along driveways, sidewalks, and walkways designed to promote dry, safe pavements clear of snow and ice.

In an attempt to solve the problems associated with removal of snow and ice from driveways, several references uncovered in the prior art have been proposed for reducing the need to manually shovel snow and ice from paved outdoor surfaces. For example, U.S. Pat. No. 4,026,350 to Zembrzuski discloses a device that is placed under a driveway surface and used in conjunction with a motor vehicle exhaust system to maintain an ice-free driveway. Likewise, U.S. Pat. No. 5,233,971 to Hanley discloses a solar heated driveway pad that includes a solar collector panel positioned adjacent thereto arranged to direct fluid and heat flow through the pad of the driveway for melting snow and ice therefrom. Varieties of other prior art devices are disclosed in U.S. Pat. Nos. 4,967,057; 4,814,580; 4,646,818.

Despite these prior art devices, there is still a further need to provide an improved driveway heating system. Such a driveway heating system should transfer heat directly to pavement structures so that the surfaces associated with those pavement structures can be maintained in a snow-free, ice-free condition. Moreover, such a driveway heating system should be capable of being readily incorporated in any paved outdoor surfaces regardless of their shapes and contours.

While these units mentioned above may be suitable for the particular purpose employed, or for general use, they would not be as suitable for the purposes of the present invention as disclosed hereafter.

SUMMARY OF THE INVENTION

It is an object of the invention to provide a driveway heating system which transfers heat directly to pavement structures so that the surfaces associated with those pavement structures can be maintained in a snow-free, ice-free condition.

It is another object of the invention to provide a driveway heating system which can be readily incorporated in any paved outdoor surfaces regardless of their shapes and contours.

It is yet another object of the invention to provide a driveway heating system which employs a plurality of electric heating devices placed along driveways, sidewalks, walkways to melt snow and ice from the surfaces thereof in the event of a snow storm and thereby promoting dry, safe outdoor surfaces for driving and walking.

It is a further object of the invention to provide heating devices having four side panels, wherein the side panels facing toward a pavement structure are constructed of high thermal conducting material, and the side panels facing away from the pavement structure are constructed of thermal insulating material designed to maximize heat transfer to the pavement structure.

The invention is a driveway heating system for maintaining outdoor paved surfaces free of snow and ice comprising a plurality of electric heating devices placed along the outdoor paved surfaces adapted to melt snow and ice therefrom in the event of a snow storm. The heating device includes a housing defined in part by exterior panels, wherein the exterior panels facing toward the pavement structure are constructed of high thermal conducting material, and the exterior panels facing away from the pavement structure are constructed of thermal insulating material designed to maximize heat transfer to the pavement structure. The housing of the heating device serves to contain an electrically powered heat source. When the heating device is activated, the heat released from the heat source raises the temperature of the exterior panels with high thermal conductivity to transfer the heat to the surrounding pavement structures, whereupon the heat radiates outwardly to melt snow and ice from anticipated sections of the paved surfaces.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
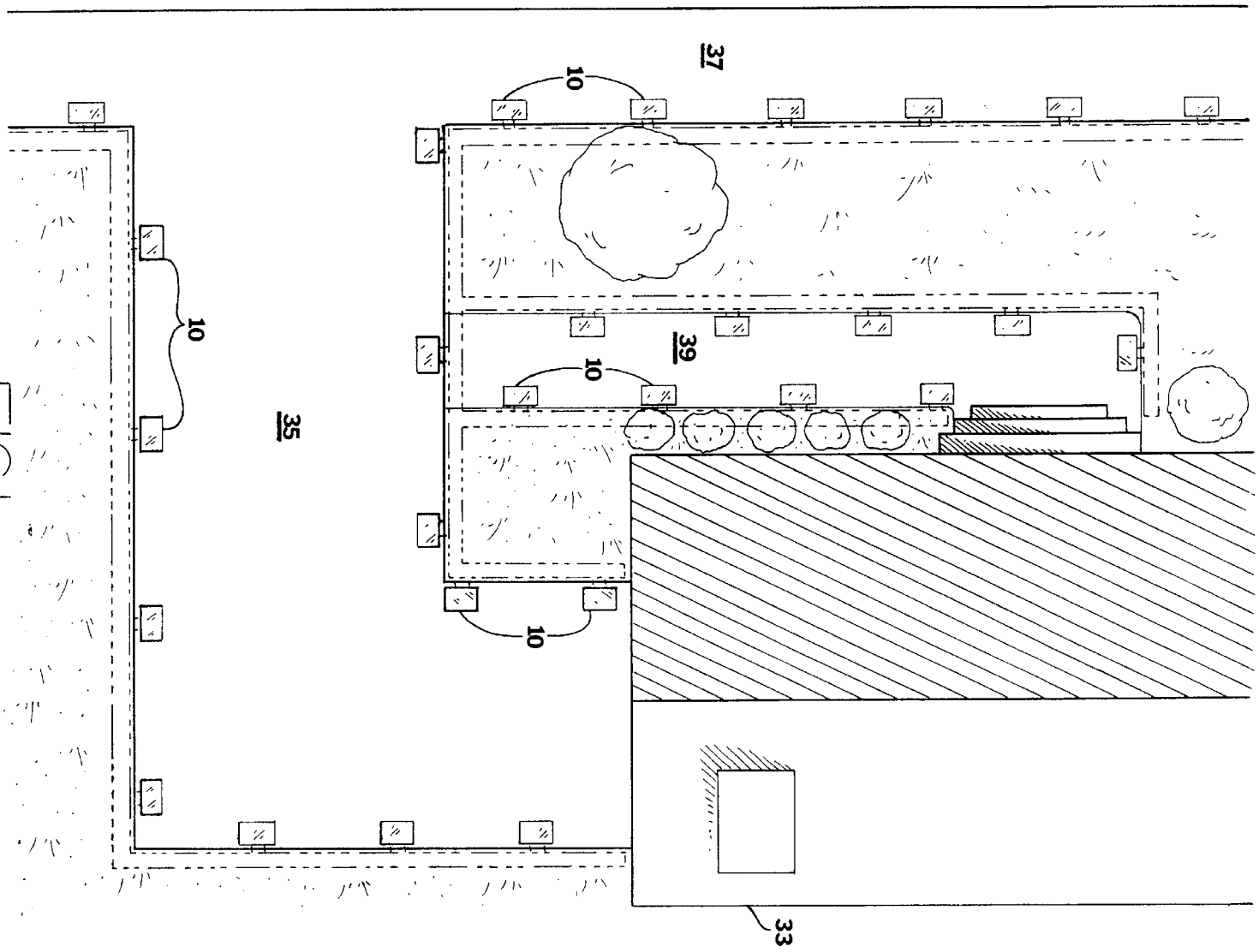
FIG. 1 is a top plan view of a residential house incorporating the principles of the present invention, illustrating a plurality of electric heating devices placed along the driveway, sidewalk, and walkway.

FIG. 1 illustrates a residential home incorporating the principles of the present invention. For a better understanding of the present invention, a typical residential house 33 is illustrated having a driveway 35, a sidewalk 37, and a walkway 39 leading from the driveway 35 to a front entrance door. The driveway heating system of the present invention comprises a plurality of electric heating devices placed along the pavement structures to keep the surfaces associated with those paved structures free of snow and ice.

Figure 2:
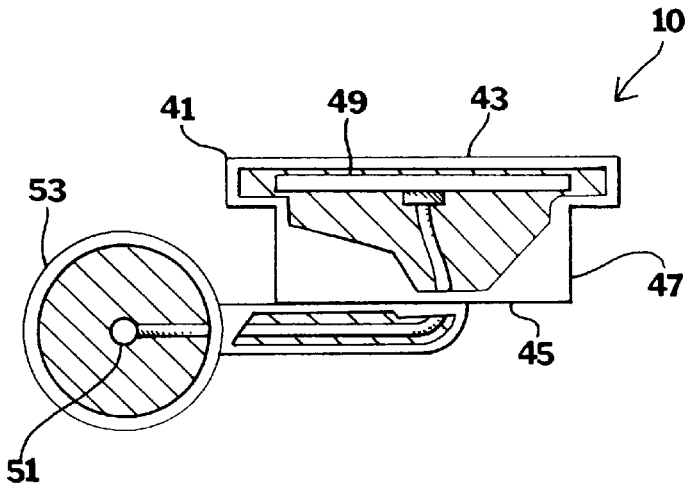
FIG. 2 is a cross-sectional side elevational view of the electric heating device of the present invention.
Figure 3:
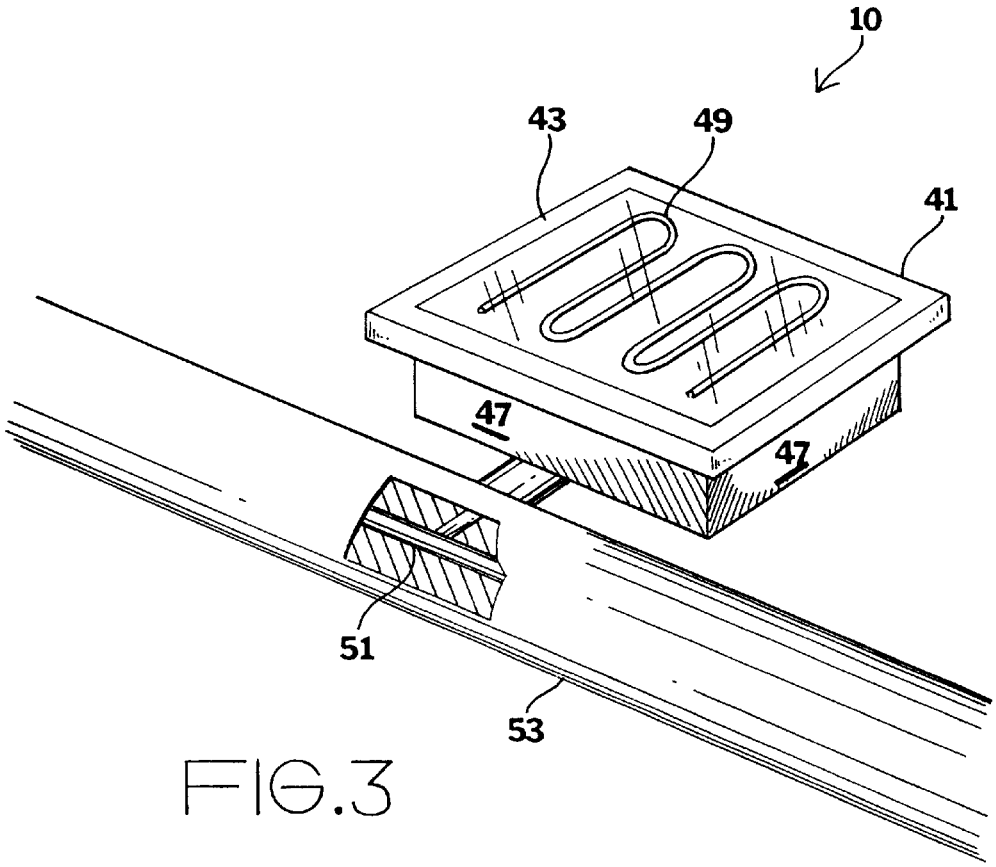
FIG. 3 is a diagrammatic perspective view of the heating device, illustrating a pipe enclosing line connectors with a part thereof broken away.

FIGS. 2 and 3 illustrate the heating device 10 including a housing 41 which preferably has a watertight construction capable of resisting any weather conditions, since the device 10 will be used outdoors. The housing 41 of the heating device defined by a top panel 43, a bottom panel 45, and side panels 47. One important feature of the present invention is way the housing 41 is adapted to allow most of the heat generated within the device 10 to dissipate toward the pavement structure rather than away from it. Accordingly, to enhance heat transferability, at least one of the side panels 47 is constructed of a material possessing high thermal conducting properties such as aluminum, copper, steel, and the like. In addition, the top panel 43, the bottom panel 45, and the side panels 47 facing away from the pavement structures are preferably constructed of thermal insulating material to prevent heat radiating away from the paved surfaces.

The housing 41 of the present device serves to contain an electrically powered heat source 49 of any suitable type, for example, the heat source 49 can take the form of an electrically resistive metallic heating element that generates heat when electric currents are passed through it. In an alternative embodiment, the heat source 49 is of type, that emits light as well as heat, such as an incandescent lamp, infrared lamp, and the like. In this alternative embodiment, the top panel 43 of the housing 41 is constructed of durable transparent material so as to allow the heating devices 10 to furnish illumination as well as heat. The heat source 49 of the present invention is preferably of type well known to persons of ordinary skill in the art and forms no part of the present invention.

FIGS. 2 and 3 illustrate a line connector 51 for interconnecting to any suitable power source such as an AC utility power source for directing electrical current to the heating devices 10. The line connector 51 can be kept protected from the elements of outdoor environments by means of plastic pipes 53 or any other suitable means as would be appreciated by those skilled in the art. The driveway heating system of the present invention may be provided with a control unit, which is not shown here, connected between the power source and the heating devices 10 for allowing an indiviudal to manually select the amount of heat to be provided thereby. The control unit may include a step-down transformer for voltage conversion when used with the AC utility power source, and a thermostat and temperature setting controls for selectively switching the heating source 49 on and off according to the settings and current temperature at the control unit.

Figure 4:
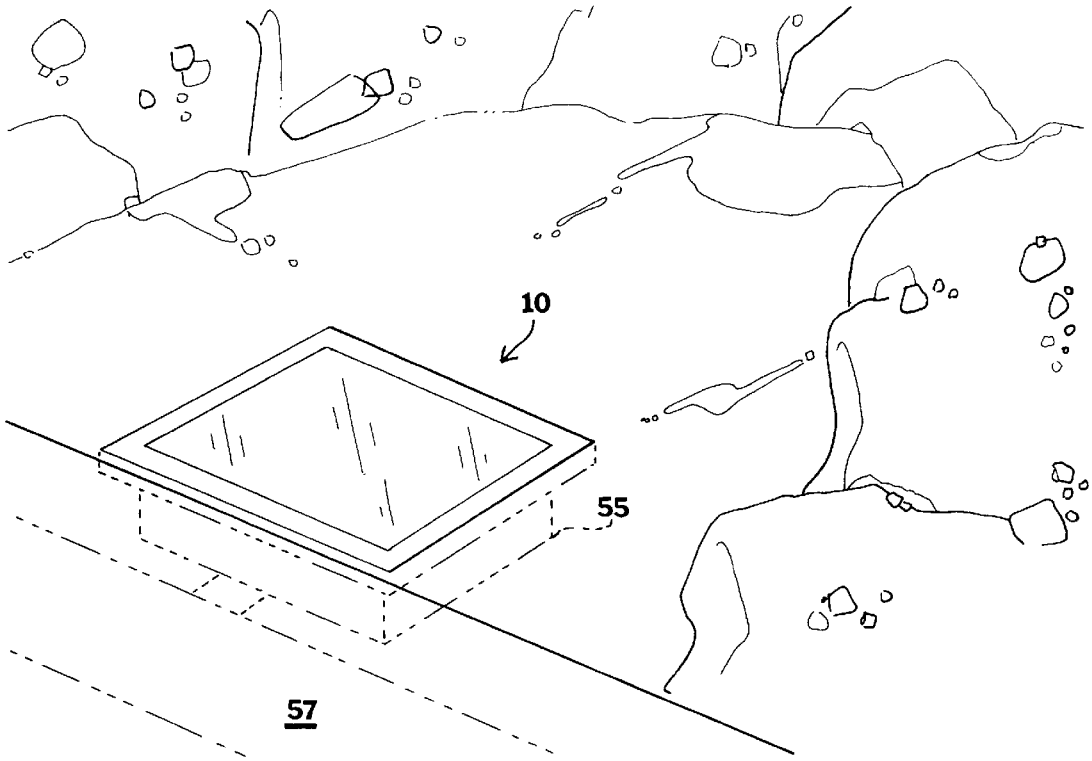
FIG. 4 is a diagrammatic perspective view of an alternative embodiment of the present invention, illustrating the heating device placed within a recess formed in the ground adjacent a paved structure.

The placement of the electric heating devices 10 may be carried out in a number of ways. Referring back to FIG. 1, one method of the present invention contemplates placing the heating devices 10 within the pavement structure by first forming a plurality of recesses therein sized and shaped to receive the heating devices. The heating devices are then placed within those recess holes such that the side panel possessing high thermal conductivity faces toward the pavement structure to allow the heat generated within the devices to dissipate toward the preselected sections of the paved surfaces. Alternatively, as seen by referring to FIG. 4, another method of the present invention contemplates embedding the heating devices 10 within a recess 55 formed in the ground adjacent the pavement structure 57 such that the heat radiating from the heating device 10 can be transferred to the paved surfaces.

The operation of the driveway heating system will now be described. The heat source 49 of the present invention has resistive property which generate heat when electric current are passed through them. The heat released from the heat source raises the temperature of the side panels 47 with high thermal conductivity and thereby transferring heat to the surrounding pavement structures by conduction. Since most pavement structures possess relatively high thermal conductivity, the heat transferred to the pavement structures will radiate outwardly to melt snow and ice from anticipated sections of the paved surfaces in the event of a snowstorm. Thus, in accordance with the present invention, the driveway heating system maintains the driveways 35, sidewalks 37, and walkways 39 in dry and safe condition, and effectively eliminates the need to manually remove snow and ice therefrom.

While the embodiments of the present invention are disclosed in relation to a plurality of heating devices placed along the edges of a paved outdoor surface, it should be noted that the placement of the heating devices can be of any other suitable configuration capable of maintaining paved outdoor surface free of snow and ice, including any location between the opposing edges of a pavement structure. Many specific details contained in the above description merely illustrate some preferred embodiments and should not be construed as a limitation on the scope of the invention. Many other variations are possible.

What is claimed is:

1. An electric heating device for providing heat to an outdoor pavement structure to maintain surfaces associated therewith free of snow and ice, comprising:

a) a housing defined by a top panel, a bottom panel, and side panels, wherein panels facing toward said pavement structure are constructed of high thermal conducting material, and wherein panel facing away from said pavement structure are constructed of thermal insulating materials; and b) an electrically powered heat source within the housing for releasing heat to raise temperature of said panels with high thermal conductivity and thereby transferring heat to surrounding pavement structures by conduction when said heat source is activated.

2. The electric heating device as recited claim 1, wherein the housing has a watertight construction capable resisting any outdoor weather conditions.

3. The electric heating device as recited claim 2, wherein the heat source is an electrically resistive metallic heating element that generates heat when electric currents are passed therethrough.

4. The electric heating device as recited claim 3, wherein the heat source is of type that emits light as well as heat, and wherein the top panel of the housing is constructed of durable, transparent material so as to allow the heating device to provide illumination as well as heat.

5. The electric heating device as recited claim 3, further comprising line connectors for directing electrical energy current from an AC utility power source to the heat source, and plastic pipes enclosing said line connectors to keep said line connectors protected from elements of outdoor environments.

* * * * *